US005713251A

United States Patent [19]

Zurbuchen et al.

[11] Patent Number: 5,713,251

[45] Date of Patent: Feb. 3, 1998

[54] COMPOSITE BOX WRENCH WITH RATCHET MODULE INSERT

[75] Inventors: Gregory A. Zurbuchen, Kenosha; Dean J. Iwinski, Muskego, both of Wis.; George Ulics, Gladwin, Mich.

[73] Assignee: Snap-on Technologies, Inc., Lincolnshire, Ill.

[21] Appl. No.: 784,527

[22] Filed: Jan. 17, 1997

Related U.S. Application Data

[63] Continuation of Ser. No. 559,736, Nov. 15, 1995, abandoned.

[51] Int. Cl.[6] ..... B25B 13/46

[52] U.S. Cl. ..... 81/61; 81/900

[58] Field of Search ..... 81/60–63.2, 59.1, 81/900

[56] References Cited

U.S. PATENT DOCUMENTS

| | | | |
|---|---|---|---|
| 2,720,799 | 10/1955 | Pfost . | |
| 2,899,996 | 8/1959 | Stockman . | |
| 2,917,092 | 12/1959 | Wetty . | |
| 2,940,492 | 6/1960 | Curry et al. . | |
| 3,298,260 | 1/1967 | Rothenberg, Jr. . | |
| 3,617,613 | 11/1971 | Benzinger . | |
| 3,688,017 | 8/1972 | Roots . | |
| 3,691,000 | 9/1972 | Kalnin . | |
| 3,709,073 | 1/1973 | Kurtz . | |
| 3,742,787 | 7/1973 | Whiteford | 81/61 |
| 3,742,788 | 7/1973 | Priest . | |
| 3,776,071 | 12/1973 | Krampe . | |
| 3,792,725 | 2/1974 | Burgeson . | |
| 3,889,035 | 6/1975 | Jakes . | |
| 3,955,449 | 5/1976 | Hofmeister et al. . | |
| 4,023,450 | 5/1977 | Ygfors . | |
| 4,058,031 | 11/1977 | Magarian . | |
| 4,123,953 | 11/1978 | Corbacho, Jr. . | |
| 4,282,783 | 8/1981 | Fortune . | |
| 4,302,990 | 12/1981 | Chrichton et al. | 81/60 |
| 4,336,729 | 6/1982 | Eppenbach . | |
| 4,598,614 | 7/1986 | Kipp | 81/58.3 |
| 4,738,169 | 4/1988 | Wyka . | |
| 4,742,735 | 5/1988 | Stencel . | |
| 4,770,072 | 9/1988 | Neuhaus . | |
| 4,867,017 | 9/1989 | Holman . | |
| 4,948,647 | 8/1990 | Burkard . | |
| 4,949,600 | 8/1990 | Tricinella . | |
| 4,979,355 | 12/1990 | Ulevich . | |
| 4,986,147 | 1/1991 | Cooper . | |
| 4,992,318 | 2/1991 | Gadkarer . | |
| 5,062,328 | 11/1991 | Demurger . | |
| 5,127,614 | 7/1992 | Monnet et al. . | |
| 5,227,216 | 7/1993 | Pettit . | |
| 5,263,389 | 11/1993 | Frazzell et al. . | |
| 5,271,300 | 12/1993 | Zurbuchen et al. . | |
| 5,297,458 | 3/1994 | Smith et al. . | |
| 5,368,480 | 11/1994 | Balfour et al. . | |
| 5,392,672 | 2/1995 | Larson et al. | 81/60 |
| 5,394,773 | 3/1995 | Zurbuchen et al. . | |
| 5,461,950 | 10/1995 | Iwinski | 81/61 |

FOREIGN PATENT DOCUMENTS

| | | |
|---|---|---|
| 1251419 | 10/1971 | United Kingdom . |
| 2048179 | 4/1979 | United Kingdom . |

OTHER PUBLICATIONS

Brochure page for Fargo Mfg. Company, Inc., "Connector Wrenches " (GP–220 series—Double–ended insulated box wrenches) Certified Insulated Products brochure, (see backpage), Dec. 1993.

*Primary Examiner*—James G. Smith
*Attorney, Agent, or Firm*—Emrich & Dithmar

[57] ABSTRACT

A double-ended ratcheting box end wrench includes a body formed entirely of glass-fiber-reinforced plastic material with box-type ratcheting inserts molded at opposite ends of the body. The body includes layers of random discontinuous glass-fiber-reinforced plastic material and a band of unidirectional continuous glass-fiber-reinforced plastic material. The body is subjected to a compression molding process embedded within which are the ratcheting inserts to form a composite wrench structure. Each insert includes a two-part housing in which are disposed a ratchet gear, a pawl and a bias spring.

17 Claims, 3 Drawing Sheets

COMPOSITE BOX WRENCH WITH RATCHET MODULE INSERT

This is a continuation of application Ser. No. 08/559,736 filed Nov. 15, 1995, now abandoned.

BACKGROUND OF THE INVENTION

1. Field of the Invention

This invention relates to hand tools and the like and, more particularly, to ratcheting hand tools. The invention has particular application to hand tools of the type having non-metallic handle portions. The invention is an improvement of the ratcheting hand tool and method disclosed in copending and commonly-owned U.S. application Ser. No. 08/142,038, filed Oct. 28, 1993 and entitled "Composite Ratchet Wrench and Method of Making Same."

2. Description of the Prior Art

Conventionally, wrenches and similar hand tools have been made of iron, steel, or some other metal, because of strength and durability requirements. Metal tools are manufactured using machining, casting or forging procedures. An important disadvantage of metal tools is their cost, both from manufacturing and material standpoints. Moreover, metal tools are unsuitable for use in many applications, particularly when an electrical shock hazard or sparking condition exists for the user.

It is known to provide other plastic hand tools with metal inserts. One such arrangement is embodied in an open end wrench and is disclosed in U.S. Pat. No. 5,062,328.

A metallic ratcheting type box end is embodied in a double-ended box wrench manufactured by Fargo Mfg. Co. of New York. The Fargo wrench provides operation of its ratchet ends by way of a plastic handle, to which the ends are securely attached so as to be electrically isolated from each other. However, the ratchet ends of the Fargo tool are themselves, fully exposed and, therefore, are still subject to substantial sparking and shock risk.

The aforementioned copending U.S. application Ser. No. 08/142,038 discloses a composite hand tool which is made of compression molded, non-metallic material encapsulating a metallic gear insert formed at one end thereof. A ratchet mechanism is coaxially mounted within the gear insert and includes an axially extending drive lug which may be substantially square in transverse cross section. The disclosed ratcheting mechanism is assembled with the gear after the handle/gear combination has been molded.

SUMMARY OF THE INVENTION

It is a general object of the invention to provide an improved composite hand tool which avoids the disadvantages of prior hand tools while affording additional structural and operating advantages.

An important feature of the invention is the provision of a box-type ratchet wrench which is formed entirely of non-metallic material except for the ratcheting apparatus.

In connection with the foregoing feature, a further feature of the invention is the provision of a ratchet hand tool of the type set forth which is of relatively simple and economical construction.

A further feature of the invention is the provision of a ratcheting mechanism insert suitable for insert molding as a unit in a wrench handle.

Another feature of the invention is the provision of a method for forming a ratchet hand tool of the type set forth by insert molding, wherein there is no post-molding assembly.

These and other features of the invention are attained by providing a ratchet hand tool comprising: a totally non-metallic body including a handle portion and an insert-molded head portion, and a box-type ratcheting mechanism embedded in the head portion.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
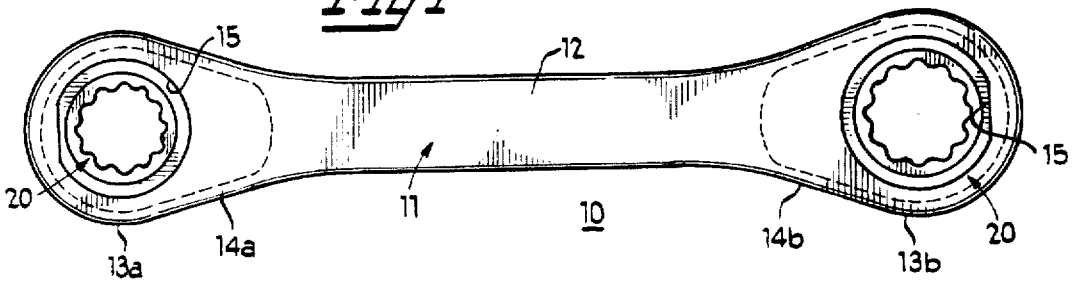
FIG. 1 is a top plan view of a double-ended, box ratchet wrench in accordance with the present invention.
Figure 2:
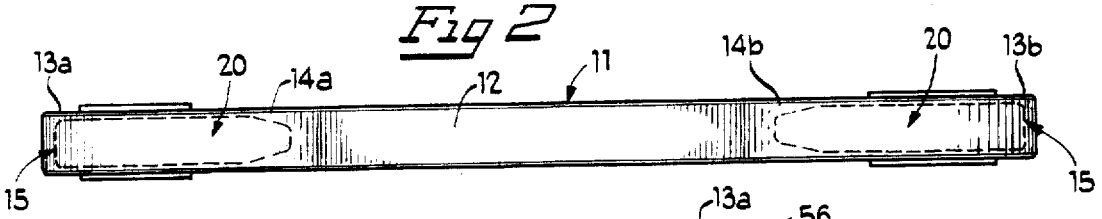
FIG. 2 is a side-elevational view of the wrench of FIG. 1.

Referring to FIGS. 1–2, there is illustrated a double-ended box-type ratchet wrench, generally designated by the numeral 10, constructed in accordance with the present invention. The ratchet wrench 10 has a body 11 of unitary, one-piece construction substantially rectangular in transverse cross section. The body 11 includes an elongated handle portion 12, annular head portions 13*a*, 13*b*, and tapered neck portions 14*a*, 14*b*, respectively connecting the handle portion 12 to the head portions 13*a*, 13*b*.

The body 11 is formed entirely of different types of glass-fiber-reinforced plastic material and is produced using a compression molding process. Formed coaxially through each of the head portions 13*a*, 13*b* is an opening 15, the inner walls of which are sized and shaped to secure a ratcheting mechanism insert or module 20 embedded therein by the insert molding process to be explained below.

Figure 3:
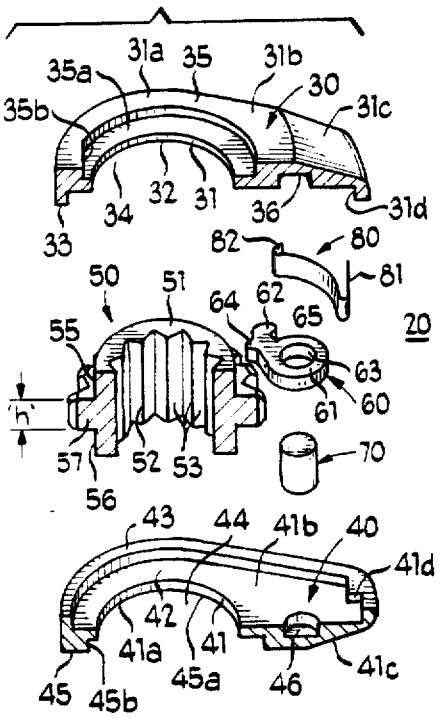
FIG. 3 is an enlarged, exploded view of a metallic ratcheting mechanism insert of the wrench of FIG. 1, with some of the components shown in partial vertical section.

Referring to FIG. 3, each ratcheting mechanism insert 20 includes a pair of housing portions 30, 40, respectively, a gear wheel 50, a pawl 60, a pivot pin 70, and a leaf spring 80, the latter defining a flat end 81 and a curved end 82.

The housing portions 30, 40 are formed as mirror images of each other and, respectively, include substantially flat central portions 31, 41, defining inside surfaces 32, 42, at the outer peripheries of which are raised walls 33, 43 of fixed height. The portions 31, 41 have part annular portions 31*a*, 41*a* and tapered lobe portions 31*b*, 41*b*. The lobe portions 31*b*, 41*b* are tapered or inclined partially along respective portions 31*c*, 41*c* thereof. The inside surfaces 32, 42 have spring-supporting portions 31*d*, 41*d* sized for engagement with the flat end 81 of spring 80.

Formed coaxially through each of the central portions 31, 41 are associated circular openings 34, 44, extending from the respective inside surfaces 32, 42 to outside surfaces 35, 45. The outside surfaces 35, 45 further include substantially circular recessed portions 35*a*, 45*a* formed coaxially about the respective openings 34, 44, and including corresponding flat surface portions 35*b*, 45*b*. Pin receiving recesses 36, 46 are provided on the inside surfaces 32, 42, respectively.

The gear wheel 50 is defined by a substantially cylindrical body 51 having an inner surface 52 on which are provided, around the entire circumference thereof, flutes or teeth 53 to facilitate gripping onto the outer surface of an associated fastener, such as a stud or bolt (not shown). The outer surface of the gear wheel 50 includes circular, cylindrical surface portions 55, 56 having a diameter just slightly less than the diameter of openings 34, 44 so as to cooperatively extend therethrough. Between portions 55, 56 is provided a radially, outwardly extending annular flange portion 57 having a height or thickness 'h' slightly less than the combined height of raised walls 33, 43 so as to be received therebetween when the ratcheting insert 20 is in the assembled condition, to be described below. The outer circumference of wall portion 57 also includes a plurality of gear teeth 58 (see FIG. 4), substantially equiangularly spaced apart.

The pawl 60 has a substantially part-cylindrical body 61 and includes a pin receiving bore 62 defined by a circular cylindrical inner surface portion 63. On the outer surface of pawl 60 is provided a gear tooth-engaging portion 64 defined by a v-shaped projection which is sized for mating engagement with the gear teeth 58 of gear wheel 50, and a spring-end receiving portion 65, sized for engagement with the curved end 82 of spring 80.

Prior to subjecting the ratchet wrench 10 to the molding process, the ratcheting insert 20 must first be assembled. During assembly (see FIGS. 4 and 5), the pivot pin 70 is placed into the pin receiving recess 46 of housing portion 40 and the cylindrical surface portion 56 of gear wheel 50 is fitted within opening 44 of housing portion 40. The pawl 60 is inserted around the pivot pin 70 and the spring 80 then resiliently engaged between the pawl spring-end receiving portion 65 and the spring-supporting portion 41*d* of housing portion 40, to bias the gear tooth-engaging portion 64 of pawl 60 against an abutting gear tooth 58 on gear wheel 50. With the gear wheel 50 so engaged, the top housing portion 30 is fitted, in like manner, over the cooperating ratcheting components, and the ratcheting insert 20 readied for mold insertion, as described below.

The above assembly steps are repeated for the oppositely positioned, different-sized ratcheting insert 20 included in the ratchet wrench 10.

Figure 6:
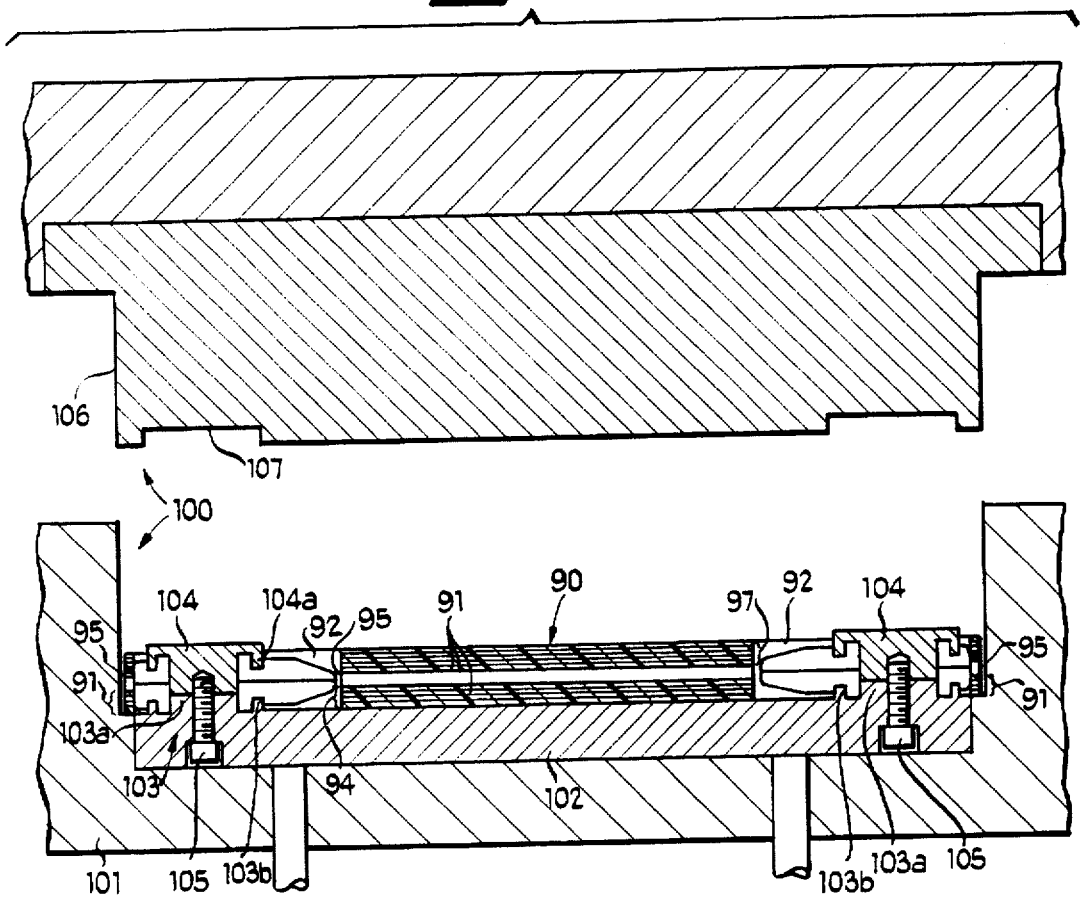
FIG. 6 is a fragmentary view in vertical section of a compression mold apparatus in its open condition preparatory to compression molding the mold charge of the ratchet wrench of FIG. 1 around two of the ratcheting mechanism inserts of FIG. 3.
Figure 7:
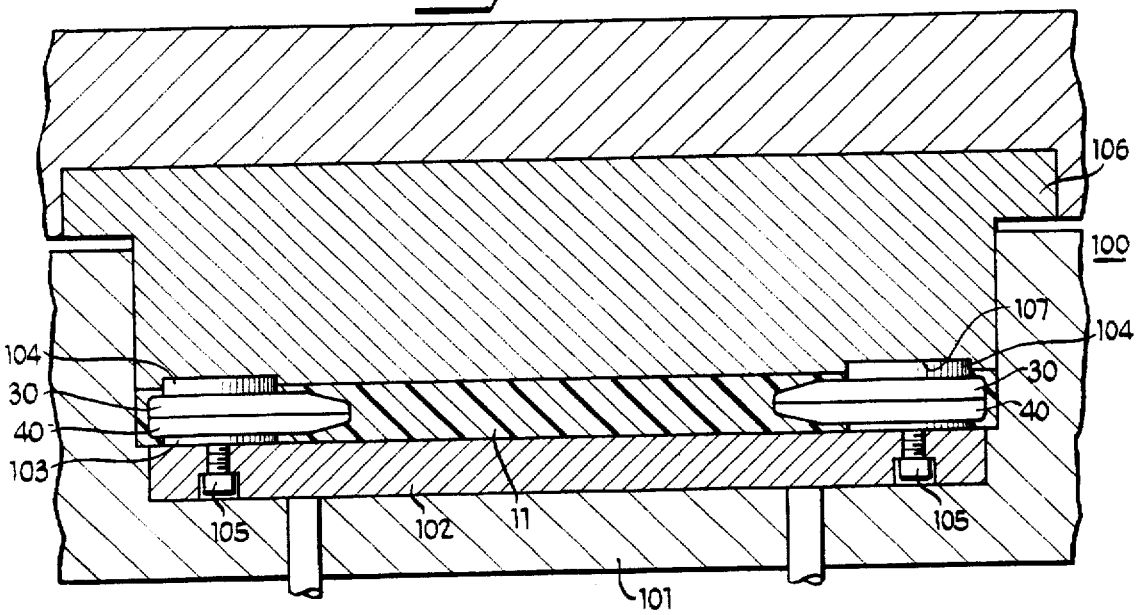
FIG. 7 is a view as in FIG. 6 but showing the compression mold apparatus in its closed condition with the mold charge in the insert-molded final state.

Referring now to FIGS. 6–7, the molding of the body 11 will be described in greater detail. A mold charge, generally designated by the numeral 90, is first formed in a known manner which is adapted to be placed in a mold apparatus 100 for each mold cycle to form the body 11. The body 11 is compression molded entirely from glass-fiber-reinforced thermoset polymer matrix sheet molding compounds. The glass-fiber-reinforcement is utilized in both chopped or discontinuous random form and in continuous unidirectional form. Preferably, the thermoset polymer matrix molding material is vinyl ester, because this material offers significant processing advantages, including fast cure rate and workability. However, the body 11 could be made of glass-fiber-reinforced epoxy materials or other plastics.

The mold charge 90 is formed primarily of a plurality of layers 91, each individually die cut in the general shape of the ratchet wrench 10 from a sheet of sheet molding compound, each layer 91 having circular holes 92 (shown in vertical cross-section) cut in the respective head ends thereof. Each of the layers 91 is formed of a chopped or discontinuous random-oriented glass-fiber-reinforced vinyl ester material, hereinafter referred to as random-fiber-reinforced material. In preparing the mold charge 90, a first plurality of the layers 91 is stacked in a substantially congruent arrangement to form a first stack 94. The mold charge 90 further includes a reinforcement portion in the form of a band 95, which extends substantially around the periphery of the wrench 10 and which is made of a unidirectional, continuous glass-fiber-reinforced vinyl ester material, hereinafter referred to as unidirectional-fiber-reinforced material. The band 95 is formed from a plurality of strips of the unidirectional-fiber-reinforced material and is laid over the first stack 94 in a known manner. The remaining layers 91 of the mold charge 90 are then stacked in a congruent manner to form a second stack 97, which is laid on top of the band 95 congruent with the first stack 94 to form the completed mold charge 90.

As is explained in greater detail in commonly-owned U.S. Pat. No. 5,271,300, to Zurbuchen et al., entitled "Composite Hand Tool"(the disclosure of which is incorporated herein by reference), when used together in a composite wrench, the two compounds of the layers 91 and the band 95 complement each other. The random-fiber-reinforced material of the layers 91, which forms the bulk of the wrench structure, insures that an adequate level of isotropy exists in order to handle multi-directional loading. The unidirectional-fiber-reinforced material of the band 95 allows for tailoring of local and direct strength and stiffness within the wrench structure.

The body 11 is compression molded using compression molding apparatus 100 including a hydraulic press. The molding apparatus 100 includes a female member 101, which defines a mold cavity for receiving a large drop-in mold insert 102, the latter functioning as a mounting fixture for the assembled ratcheting inserts 20. Several large, plate-form, drop-in mold inserts 102 may be used during molding, cycling them between the in-mold, preheat, and insert loading and unloading stages.

The drop-in mold insert 102 includes a pair of ratcheting insert-positioning structures 103 formed integral therewith, each such structure including a cylindrical hub portion 103*a* and an annular peripheral portion 103*b*, respectively sized to matingly engage the opening 44 and the recessed portion 45*a* of the housing portion 40 of the associated ratchet insert 20. In particular, the peripheral portion 103*b* has a flat portion engaging the flat portion 45*b*. The mold insert 102 thus serves to position the assembled, ratcheting inserts 20 thereon and retain them against rotation.

A pair of ratchet plugs (sealing caps) 104 are then fitted over the secured inserts 20 in mating engagement with the openings 34 in the top housing portions 30 thereof. Each plug 104 has a depending annular flange 104*a* which matingly engages the recessed portion 35*a* of the associated housing portion 30. The plugs 104 are then joined with the corresponding sealing hub portions 103*a* by screws 105 seated within the drop-in mold insert 102. The flat surface portions 35*b*, 45*b* of housing portions 30, 40 cooperate with like flat-shaped portions (not shown) on each corresponding one of the plug flanges 104*a* and the positioning structures peripheral portions 103*b* to lock the insert 20 in their proper orientation during molding, i.e., to prevent rotation of the inserts 20 with respect to the wrench body molding.

The molding apparatus 100 also includes a male member 106 having recesses 107 therein for respectively receiving the upper ends of the plugs 104.

Figure 8:
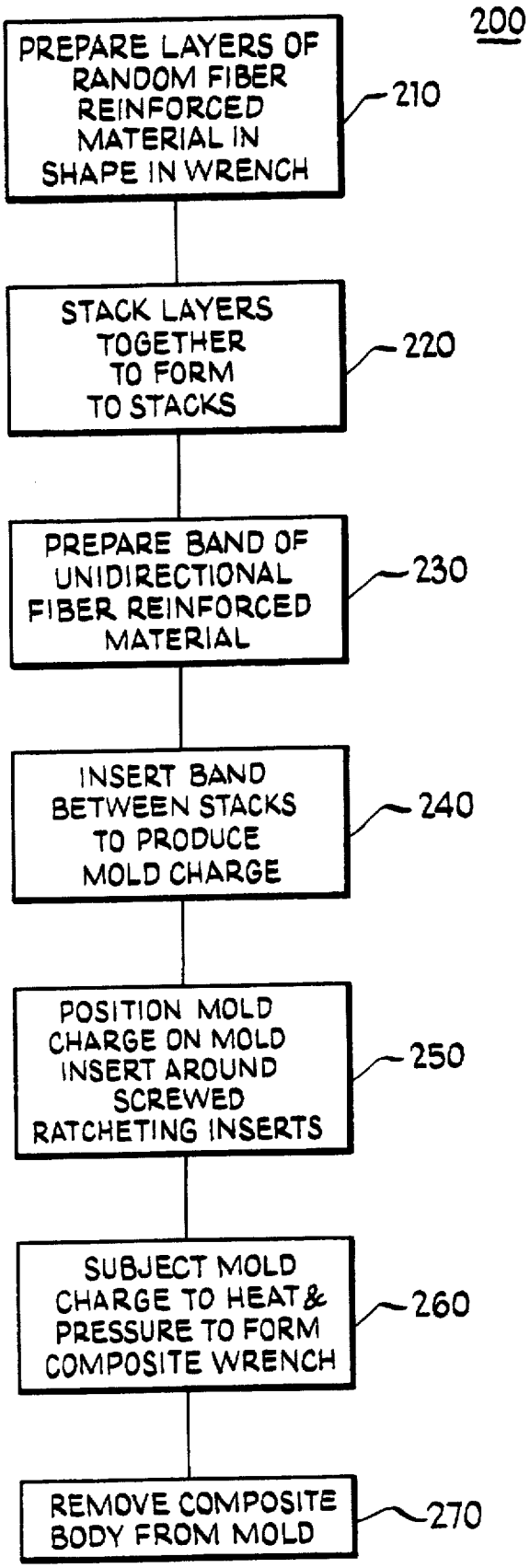
FIG. 8 is a flow chart of the steps in the process of making the ratchet wrench of FIG. 1.

Referring also to FIG. 8, the method of forming the ratchet wrench 10 will now be explained in connection with the flow chart 200 outlining the method steps. Initially, at step 210, the individual layers 91 of the random-fiber-reinforced material are die cut from the associated sheets of sheet molding compound in the general shape of the ratchet wrench 10. Next, at step 220, a first plurality of the layers 91 are stacked together to form the first stack 94 and the second group of layers 91 is stacked to form the second stack 97. Next, at step 230, the strips of unidirectional-fiber-reinforced material are gathered to form the band 95. Then, at step 240, the band 95 is insert between the first and second stacks 94 and 97 to form the mold charge 90. Next, at step 250, the mold charge 90 is positioned on the drop-in mold insert 102 with the holes 92 fitted over the ratcheting inserts 20, as is illustrated in FIG. 6, making sure that the band 95 is positioned around both ratcheting inserts 20.

Next at step 260, the molding apparatus 100 is closed, subjecting the mold charge 90 to heat and pressure to form the body 11. Then, at step 270, the finished body 11 is removed from the mold. While not shown, the molding apparatus 100 may also be provided with suitable stop spacers and ejector rods (not shown) to limit the depth of closure of the molding apparatus 100 and to facilitate ejection of the finished body 11 from the mold insert 102.

While the bulk of the mold charge 90 is made from a plurality of layers 91 of the random-fiber-reinforced material, the finished molded body 11 is ostensibly a single layer composite of unitary construction, containing both discontinuous-fiber reinforcement in random orientation and continuous-fiber reinforcement in a controlled orientation. It will be appreciated that, during the molding operation, the mold charge 90 flows to fill the space immediately above the mold insert 102 and to fill the gaps around the periphery of the inserts 20 as shown in the composite wrench structure of FIG. 7. There results a construction wherein the ratcheting inserts 20 are firmly embedded in the head portions 13*a*, 13*b* of the body 11 and are rigidly constrained against axial or rotational movement relative thereto, except in a ratcheting manner as explained above.

Because the plastic materials used to make the body 11 include no metallic components, it is non-conductive. Thus, although the ratchet wrench 10 includes metallic ratcheting inserts 20, during operation, when the user's hand is on the handle portion 12, the user is effectively protected from shock hazard. Also, the plastic composition of the body 11 results in its being corrosion resistant, non-marring, non-sparking and lightweight.

Figure 4:
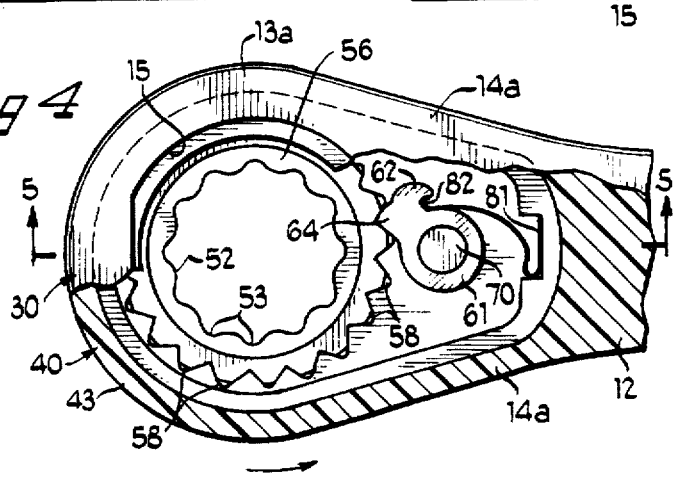
FIG. 4 is a further enlarged, fragmentary view of one end of the wrench of FIG. 1 in partial horizontal section.
Figure 5:
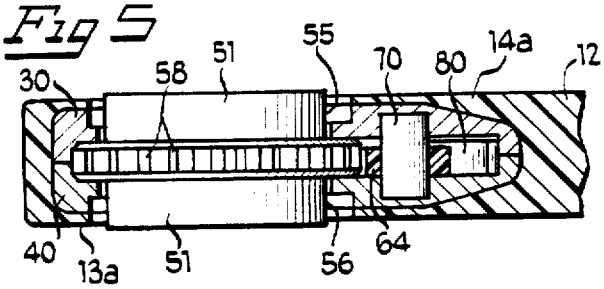
FIG. 5 is a fragmentary view in partial vertical section view taken along the line 5—5 in FIG. 4 with the ratchet wheel shown in elevation.

The operation of the ratcheting insert 20 will now be described with reference to FIG. 4, which shows the pawl 60 engaged against one of the gear teeth 58 of gear wheel 50, in a bias condition which permits counter-clockwise rotation (direction of arrow) of the gear wheel 50, in a ratcheting manner, relative to the ratchet body 11, and prevents rotation of the gear wheel 50 in the opposite direction. The use of a gear wheel, a pawl, a pivot pin and a leaf spring for accommodating ratcheting movement in a manner as above described is well known. It should be appreciated that the ratcheting directional operation of the ratcheting wrench 10 can be easily changed by merely flipping over the wrench 10.

From the foregoing, it can be seen that there has been provided an improved ratchet wrench which is of simple and economical insert-molded construction, is effectively non-conducting to protect the user from shock hazard, which is characterized by lightweight construction and ease of assembly, and is formed by a method which includes no post-molding assembly steps.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A ratchet hand tool comprising: a body formed entirely of non-metallic material and including a handle portion and a head portion, and a ratchet module permanently embedded in and encompassed by said head portion, said module including a housing and a ratchet mechanism confined in said housing for movement relative thereto, said non-metallic material encompassing said housing for cooperation therewith to fix said housing in said head portion in confining relationship with said ratchet mechanism.

2. The hand tool of claim 1, wherein said body is formed entirely of glass-fiber-reinforced plastic material.

3. The hand tool of claim 2, wherein said plastic material contains discontinuous glass-fiber reinforcement disposed in random orientation and continuous glass-fiber reinforcement disposed in a controlled orientation.

4. The hand tool of claim 3, wherein said body comprises a plurality of layers of discontinuous glass-fiber-reinforced material and a band of continuous glass-fiber-reinforced material, with said layers and said band being subjected to compression molding to form a composite structure.

5. The hand tool of claim 2, wherein said plastic material is a vinyl ester.

6. The hand tool of claim 1, wherein said ratchet hand tool is a double-ended box wrench including two ratchet modules respectively permanently embedded in opposite ends of said handle portion.

7. The hand tool of claim 1, wherein said ratchet mechanism includes a pawl, a bias spring and a gear wheel, the latter having radially outwardly extending gear teeth for engagement with said pawl to permit rotational movement of said gear wheel relative to said body in only one direction.

8. The hand tool of claim 7, wherein said housing includes two mating portions.

9. The hand tool of claim 7, wherein said gear wheel defines a fastener-receiving aperture.

10. The hand tool of claim 1, wherein said module is formed of metal.

11. The hand tool of claim 6, wherein each of said modules is formed of metal.

12. The hand tool of claim 8, wherein said mating portions respectively have aligned openings therethrough.

13. The hand tool of claim 12, wherein each of said openings is generally circular in shape, at least one of said openings having a flat portion thereon.

14. The hand tool of claim 12, wherein said ratchet mechanism includes an annular gear wheel with a central aperture therethrough disposed coaxially with said openings.

15. The hand tool of claim 14, wherein said aperture is non-circular in shape.

16. A ratchet hand tool comprising:

a ratchet module including a housing and a ratchet mechanism disposed in said housing, said housing including first and second portions mateably engageable with each other in a closed condition for confining said ratchet mechanism within said housing while accommodating movement of said ratchet mechanism relative to said housing, and a body formed entirely of non-metallic material and including a handle portion and a head portion, said module being permanently embedded in said head portion with said non-metallic material encompassing said first and second housing portions for cooperation therewith to fix said module in said head portion and retain said first and second housing portions in their closed condition.

17. A hand tool comprising:

a body formed entirely of non-metallic material and including a handle portion and a head portion, two confining members embedded in and encompassed by said head portion, a fastener-engaging ratchet gear rotatably carried by said head portion between said confining members, and a pawl rotatably carried by said head portion between said confining members externally of said gear for ratcheting engagement with said gear, said confining members cooperating with said gear and said pawl to prevent non-rotational movement of said gear and said pawl relative to each other.

* * * * *